US009777927B2

(12) United States Patent
Armstrong et al.

(10) Patent No.: US 9,777,927 B2
(45) **Date of Patent: *Oct. 3, 2017**

(54) DOUBLE OVEN PREHEAT BOOST USING COOKING CHAMBER LOCKOUT

(71) Applicant: General Electric Company, Schenectady, NY (US)

(72) Inventors: James Lee Armstrong, Louisville, KY (US); Joshua Stephen Wiseman, Elizabethtown, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 458 days.

This patent is subject to a terminal disclaimer.

(21) Appl. No.: 14/507,987

(22) Filed: Oct. 7, 2014

(65) Prior Publication Data

US 2016/0097542 A1 Apr. 7, 2016

(51) Int. Cl.
*F24C 7/08* (2006.01)
*H05B 3/00* (2006.01)

(52) U.S. Cl.
CPC ..... *F24C 7/087* (2013.01); *F24C 7/08* (2013.01); *F24C 7/082* (2013.01); *F24C 7/085* (2013.01); *H05B 3/0076* (2013.01)

(58) Field of Classification Search
CPC .. F24C 7/08; F24C 7/085; F24C 7/087; F24C 7/082; F24C 7/046; H05B 3/0076
USPC ..... 126/19 R, 42
See application file for complete search history.

(56) References Cited

U.S. PATENT DOCUMENTS

| | | | | |
|---|---|---|---|---|
| 7,368,686 | B2 * | 5/2008 | Etheredge | F24C 7/087 219/394 |
| 8,049,142 | B2 | 11/2011 | Blackson et al. | |
| 8,242,413 | B2 * | 8/2012 | Choi | F24C 15/322 126/332 |
| 9,506,657 | B2 * | 11/2016 | Armstrong | F24C 7/082 |
| 2006/0016445 | A1 * | 1/2006 | Cadima | F24C 3/124 126/39 BA |
| 2012/0100492 | A1 * | 4/2012 | Hodapp, Jr. | F24C 3/126 431/12 |

OTHER PUBLICATIONS

Co-pending U.S. Appl. No. 14/507,996, filed Oct. 7, 2014.

* cited by examiner

*Primary Examiner* — Arthur O Hall
*Assistant Examiner* — Christopher R Dandridge
(74) *Attorney, Agent, or Firm* — Dority & Manning, P.A.

(57) ABSTRACT

An oven appliance is provided with features for locking out a cooking chamber to boost the preheat performance of and thereby decrease the time required to preheat another cooking chamber of the oven appliance. A method for operating an oven appliance also is provided. The method includes features for locking out a cooking chamber to boost the preheat performance of and thereby decrease the time required to preheat another cooking chamber of the oven appliance.

19 Claims, 6 Drawing Sheets

DOUBLE OVEN PREHEAT BOOST USING COOKING CHAMBER LOCKOUT

FIELD OF THE INVENTION

The subject matter of the present disclosure relates generally to an oven appliance and features for preheating an oven appliance.

BACKGROUND OF THE INVENTION

Oven appliances generally include a cabinet that defines one or more cooking chambers for baking or broiling food items therein. Oven appliances also generally include a self-cleaning feature for cleaning the one or more cooking chambers. To heat the cooking chambers for baking or for self-cleaning, oven appliances include one or more heating elements positioned at a top portion, bottom portion, or both of the cooking chambers. Some oven appliances also include a convection heating element and fan for convection cooking cycles. The heating element or elements may be used for various cycles of the oven appliance, such as a preheat cycle, a cooking cycle, or a self-cleaning cycle.

The time required to preheat a typical electric oven appliance to 350° F. generally varies from about nine to about fifteen minutes, depending on the oven size and the oven rack type. The required preheat time may be a nuisance to a user of the oven appliance waiting to cook her food. However, because the power that may be input to an electric oven appliance is limited by the amount of current the appliance can pull from the breaker, adding heating elements or using multiple heating elements at one time may not be a viable solution. Moreover, in oven appliances having two cooking chambers, the power available to each cooking chamber is approximately one half of the power available to a single cooking chamber oven appliance. Thus, double oven appliances generally are limited as to additional sources of heat that may be input into a cooking chamber to decrease the time required to preheat the cooking chamber.

Accordingly, an oven appliance with features for minimizing the preheat time without exceeding the wattage available to the oven appliance would be useful. Further, a method for operating an oven appliance to minimize the preheat time without exceeding the wattage available to the oven appliance would be beneficial.

BRIEF DESCRIPTION OF THE INVENTION

The present invention provides an oven appliance with features for locking out a cooking chamber to boost the preheat performance of and thereby decrease the time required to preheat another cooking chamber of the oven appliance. A method for operating an oven appliance also is provided. The method includes features for locking out a cooking chamber to boost the preheat performance of and thereby decrease the time required to preheat another cooking chamber of the oven appliance. Additional aspects and advantages of the invention will be set forth in part in the following description, may be apparent from the description, or may be learned through practice of the invention.

In a first exemplary embodiment, a method for operating an oven appliance is provided. The oven appliance includes an upper cooking chamber and a lower cooking chamber each configured for receipt of food items for cooking. The method includes the steps of establishing a cooking chamber temperature set point $T_{pre}$ for a selected cooking chamber, wherein the selected cooking chamber comprises one of the upper or the lower cooking chamber; activating a heating element of the selected cooking chamber; determining whether a boost preheat mode of the selected cooking chamber has been chosen and, if so, then activating a lockout element to lockout the unselected cooking chamber; activating an additional heating element of the selected cooking chamber; sensing whether the temperature in the selected cooking chamber has reached at least $T_{pre}$ and, if so, then activating the lockout element to unlock to the unselected cooking chamber, and initiating a cooking cycle of the selected cooking chamber.

In a second exemplary embodiment, a method for operating an oven appliance is provided. The oven appliance includes an upper cooking chamber and a lower cooking chamber each configured for receipt of food items for cooking. The method includes the steps of establishing a cooking chamber temperature set point $T_{pre}$ for a selected cooking chamber, wherein the selected cooking chamber comprises one of the upper or the lower cooking chamber; activating a heating element of the selected cooking chamber; determining whether a boost preheat mode of the selected cooking chamber has been chosen and, if so, then activating a lockout element to lockout the unselected cooking chamber; counting a time $t_{lock}$; activating an additional heating element of the selected cooking chamber; determining whether the time $t_{lock}$ has reached at least a threshold time $t_{thr}$ and, if so, then activating the lockout element to unlock to the unselected cooking chamber.

In a third exemplary embodiment, an oven appliance is provided. The oven appliance includes a cabinet defining an upper cooking chamber and a lower cooking chamber, each of the upper and lower cooking chamber configured for receipt of food items for cooking; a plurality of upper heating elements, the upper heating elements configured to heat the upper cooking chamber; a plurality of lower heating elements, the lower heating elements configured to heat the lower cooking chamber; a lockout element; and a controller in operative communication with the upper and lower heating elements and the lockout element. The controller is configured for establishing a cooking chamber temperature set point $T_{pre}$ for a selected cooking chamber, wherein the selected cooking chamber comprises one of the upper or the lower cooking chamber; activating one of the plurality of heating elements of the selected cooking chamber; determining whether a boost preheat mode of the selected cooking chamber has been chosen and, if so, then activating the lockout element to lockout the unselected cooking chamber; activating an additional heating element of the selected cooking chamber; sensing whether the temperature in the selected cooking chamber has reached at least $T_{pre}$ and, if so, then activating the lockout element to unlock to the unselected cooking chamber, and initiating a cooking cycle of the selected cooking chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
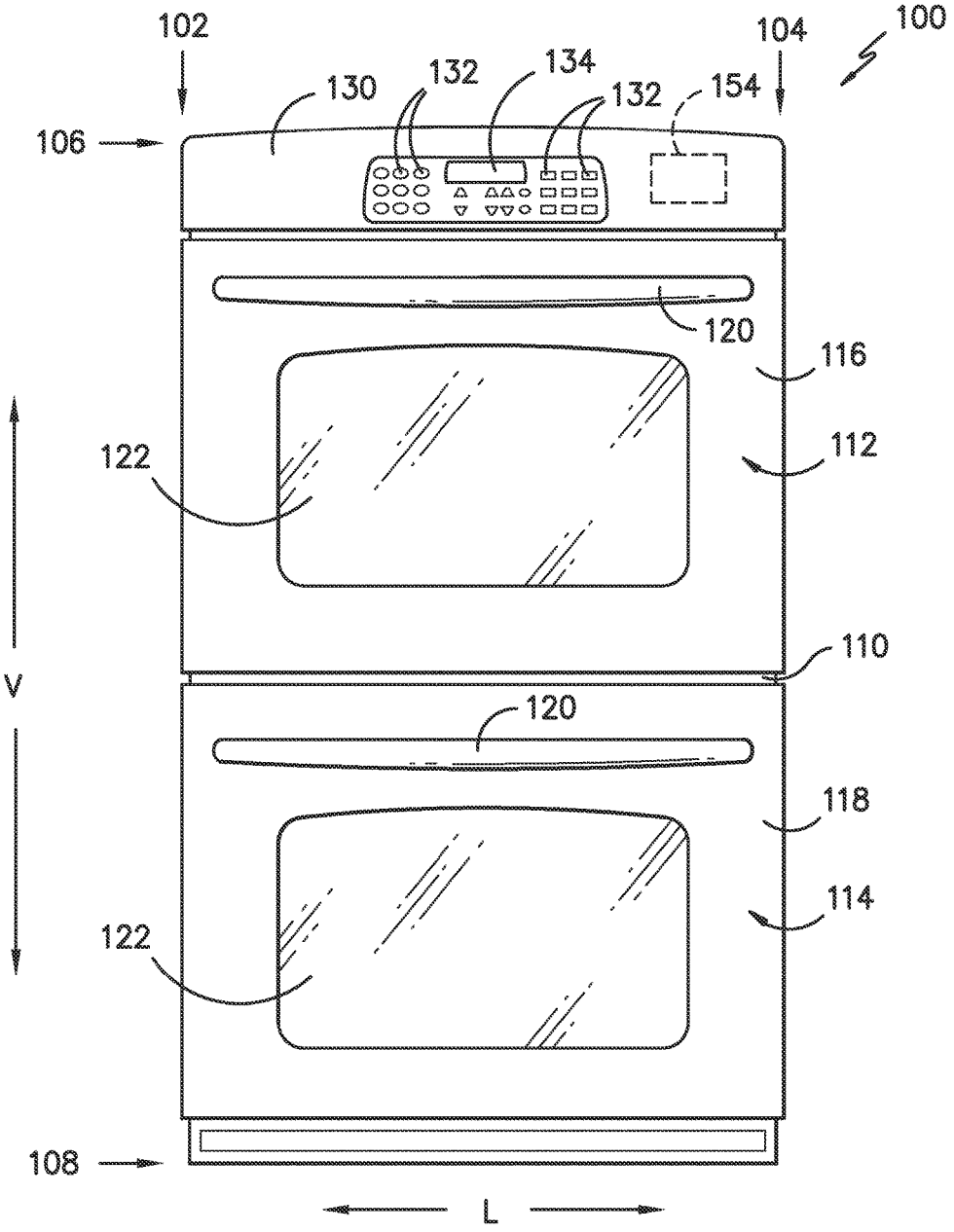
FIG. 1 provides a front, elevation view of an oven appliance having an upper and a lower cooking chamber according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of an oven appliance 100 according to an exemplary embodiment of the present subject matter. Oven appliance 100 defines a vertical direction V, a lateral direction L and a transverse direction T (not shown). The vertical direction V, lateral direction L and transverse direction T are mutually perpendicular and form an orthogonal direction system. Oven appliance 100 includes an insulated oven body 110 that extends between a first side portion 102 and a second side portion 104, e.g., along a lateral direction L. Body 110 also extends between a top portion 106 and a bottom portion 108, e.g., along the vertical direction V.

Body 110 defines an upper cooking chamber 112 and a lower cooking chamber 114. Upper cooking chamber 112 is positioned at or adjacent top portion 106 of body 110. Lower cooking chamber 114 is positioned at or adjacent bottom portion 108 of body 110. Oven appliance 100 is generally referred to as a double wall oven appliance. As will be understood by those skilled in the art, oven appliance 100 is provided by way of example only, and the present subject matter may be used in any suitable oven appliance, e.g., a double oven range appliance. Thus, the exemplary embodiment shown in FIG. 1 is not intended to limit the present subject matter in any aspect.

Upper and lower cooking chambers 112 and 114 are configured for the receipt of one or more food items to be cooked. Oven appliance 100 includes an upper door 116 and a lower door 118 pivotally attached to body 110 to permit selective access to upper cooking chamber 112 and lower cooking chamber 114, respectively. Handles 120 are mounted to upper and lower doors 116 and 118 to assist a user with opening and closing doors 116 and 118 to access cooking chambers 112 and 114. As an example, a user can pull on handle 120 mounted to upper door 116 to open or close upper door 116 and access upper cooking chamber 112. Glass window panes 122 provide for viewing the contents of upper and lower cooking chambers 112 and 114 when doors 116 and 118 are closed and also assist with insulating upper and lower cooking chambers 112 and 114. Oven appliance 100 can include a seal (not shown) between doors 116, 118 and cabinet 110 that assists with maintaining heat and cooking fumes within cooking chambers 112, 114 when doors 116, 118 are closed as shown in FIG. 1.

Figure 2:
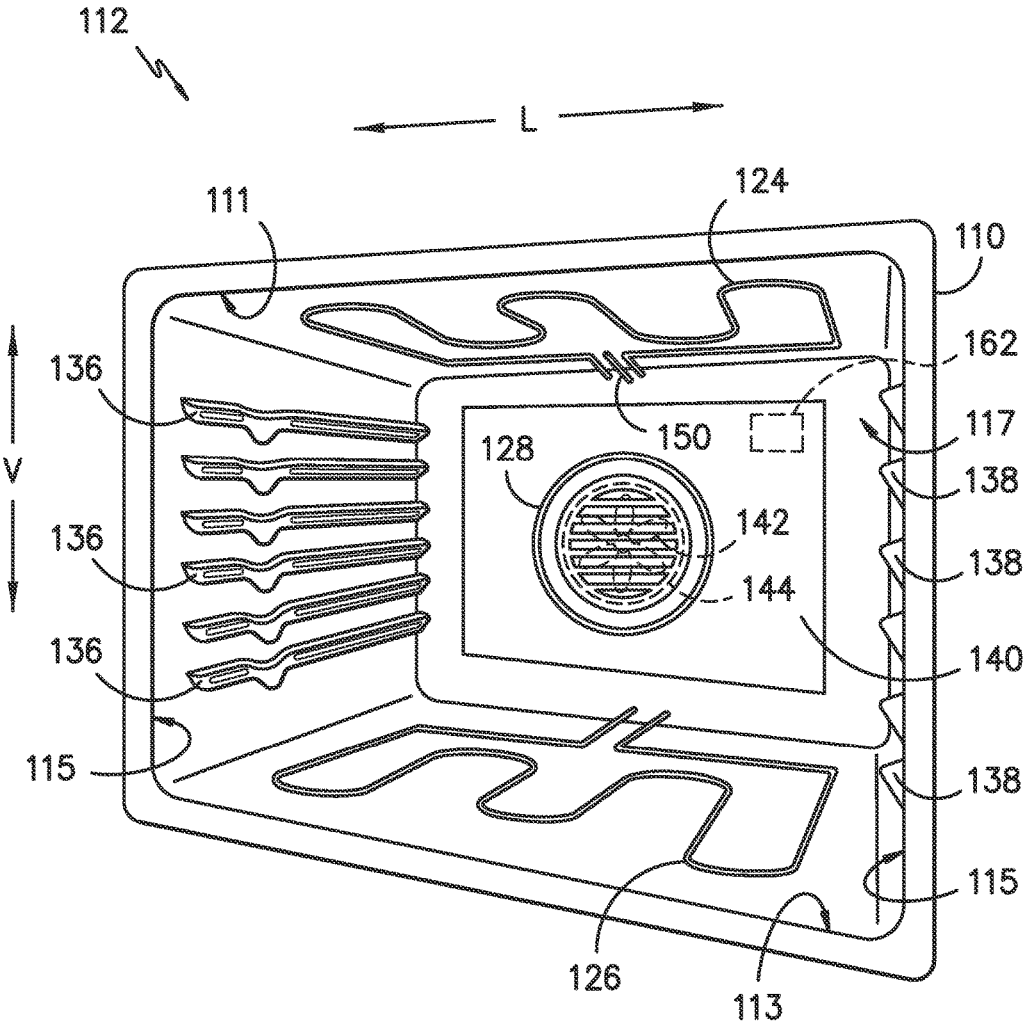
FIG. 2 provides a perspective view of an exemplary embodiment of the upper cooking chamber of the oven appliance of FIG. 1.

Referring to FIG. 2, for this exemplary embodiment, upper cooking chamber 112 is defined by a top wall 111, a bottom wall 113, opposing side walls 115, and a back wall 117. A baking rack (not shown) for the receipt of food items or utensils containing food items may be slidably received onto embossed ribs or sliding rails 136, 138 such that the rack may be conveniently moved into and out of upper cooking chamber 112 when door 116 is open. A plurality of upper heating elements, including a heating element at the top, bottom, or both of upper cooking chamber 112, provides heat from an energy source or power supply 162 to cooking chamber 112 for cooking. Such heating element(s) can be, e.g., gas, electric, microwave, or a combination thereof. For example, in the embodiment shown in FIG. 2, upper cooking chamber 112 includes an upper broil heating element 124 and an upper bake heating element 126, which are connected to power supply 162. To boost preheat performance, as further described below, upper cooking chamber 112 may also include an upper boost heating element 128 connected to power supply 162.

The plurality of upper heating elements also includes an upper convection heating element 144, which is positioned with an upper convection fan 142 behind a protective panel 140 adjacent back wall 117. Fan 142 may provide air movement in upper cooking chamber 112 during, e.g., convection modes of oven appliance 100. Other configurations of upper convection fan 142 and upper convection heating element 144 may be used as well.

Further, a temperature sensor 150 may be located adjacent top wall 111. In alternative embodiments, temperature sensor 150 may be positioned in another location within upper cooking chamber 112. In still other embodiments, oven appliance 100 may include more than one temperature sensor within upper cooking chamber 112. Temperature sensor 150 may be a resistive temperature device (RTD) or any other suitable sensor.

Figure 3:
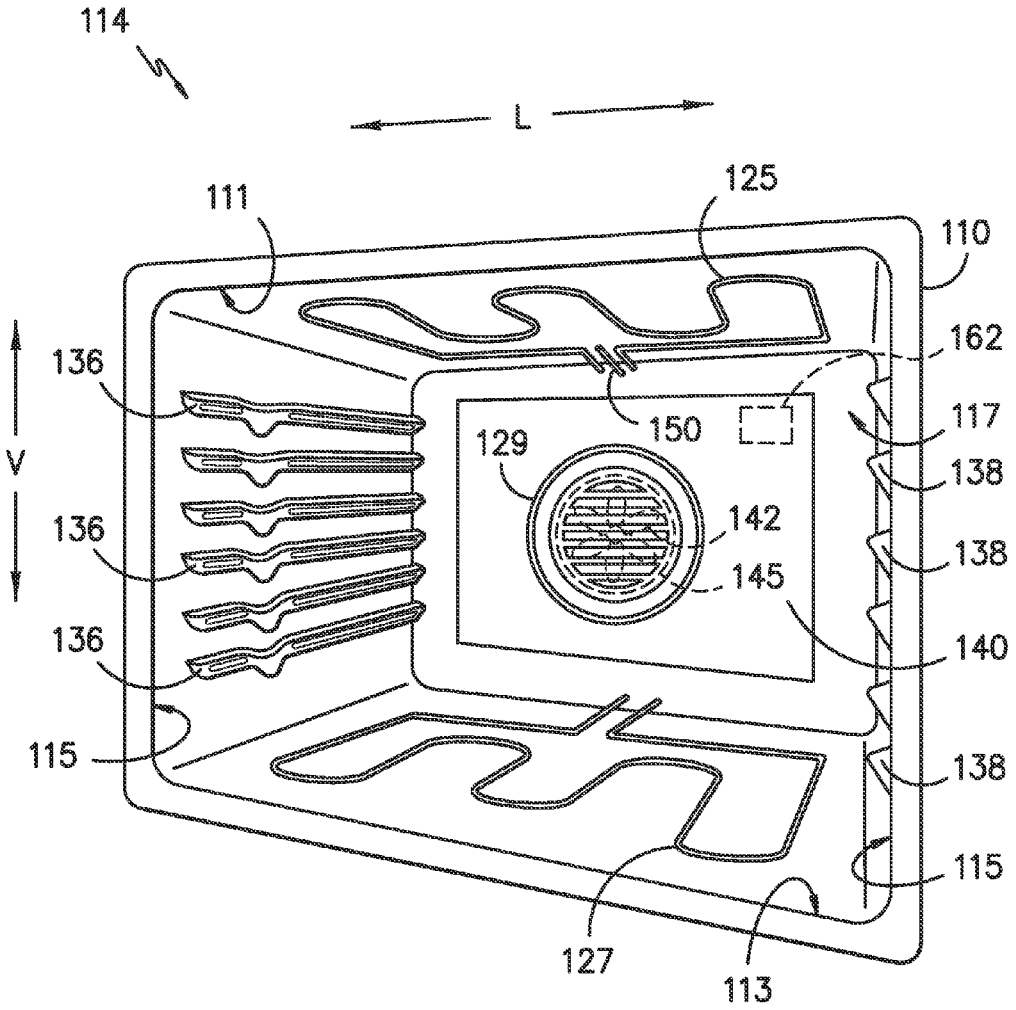
FIG. 3 provides a perspective view of an exemplary embodiment of the lower cooking chamber of the oven appliance of FIG. 1.

As shown in FIG. 3, lower cooking chamber 114 may be configured similarly to upper cooking chamber 112. Accordingly, lower cooking chamber 114 may be defined by a top wall 111, a bottom wall 113, opposing side walls 115, and a back wall 117. A baking rack (not shown) for the receipt of food items or utensils containing food items may be slidably received onto embossed ribs or sliding rails 136, 138 such that the rack may be conveniently moved into and out of lower cooking chamber 114 when door 118 is open. In the embodiment shown in FIG. 2, lower cooking chamber 114 has a plurality of lower heating elements, including a lower broil heating element 125, a lower bake heating element 127, and a lower convection heating element 145, which are connected to power supply 162. To boost preheat performance, as further described below, lower cooking chamber 114 may also include a lower boost heating element 129 connected to power supply 162. Heating elements 125, 127, 129 can be, e.g., gas, electric, or microwave heating elements, or a combination thereof.

Lower cooking chamber 114 also includes a lower convection fan 143, which is positioned with lower convection heating element 145 behind a protective panel 140 adjacent back wall 117. Fan 143 may provide air movement in lower cooking chamber 114 during, e.g., convection modes of oven appliance 100. Other configurations of lower convection fan 143 and lower convection heating element 145 may be used as well.

Further, a temperature sensor 150 may be located adjacent top wall 111. In alternative embodiments, temperature sensor 150 may be positioned in another location within lower cooking chamber 114. In still other embodiments, oven appliance 100 may include more than one temperature sensor within lower cooking chamber 114. Temperature sensor 150 may be a resistive temperature device (RTD) or any other suitable sensor.

Referring back to FIG. 1, oven appliance 100 includes a control panel 130 having a display 134 and a variety of controls 132. Using controls 132, a user of oven appliance 100 may select various options for the operation of oven 100 including, e.g., temperature, time, and/or various cooking and cleaning cycles of cooking chambers 112, 114. Information as to, e.g., the operation of oven 100 may be shown on display 134, which can be a liquid crystal display, a dot matrix display, a series of seven-segment displays, etc.

Operation of oven appliance 100 can be regulated by a controller 154 that is operatively coupled, i.e., in communication with, control panel 130, upper heating elements 124, 126, 128, 144, lower heating elements 125, 127, 129, 145, fans 142, 143, and/or other components of oven 100. For example, in response to user manipulation of the control panel 130, controller 154 can operate the heating element(s). As a further example, controller 154 can receive measurements from temperature sensor 150 placed in upper cooking chamber 112 and, e.g., provide a temperature indication to the user with display 134. Controller 154 can also be provided with other features as will be further described herein.

Controller 154 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 154 may be positioned in a variety of locations throughout oven appliance 100. In the illustrated embodiment, controller 154 is located within control panel 130. In other embodiments, controller 154 may be located at any other appropriate location with respect to oven appliance 100. In the embodiment shown in FIG. 1, input/output ("I/O") signals are routed between controller 154 and various operational components of oven appliance 100 such as upper heating elements 124, 126, 128, 144, lower heating elements 125, 127, 129, 145, fans 142, 143, controls 132, display 134, temperature sensor 150, alarms, and/or other components as may be provided, such as lockout elements 164, 165 described below. In one embodiment, the control panel 130 may represent a general purpose I/O ("GPIO") device or functional block.

Although shown with touch type controls 132, it should be understood that controls 132 and the configuration of oven appliance 100 shown in FIG. 1 is provided by way of example only. More specifically, control panel 130 may include various input components, such as one or more of a variety of electrical, mechanical, or electro-mechanical input devices including rotary dials, push buttons, and touch pads. Panel 130 may include other display components, such as a digital or analog display device designed to provide operational feedback to a user. Panel 130 may be in communication with controller 154 via one or more signal lines or shared communication busses.

Figure 4:
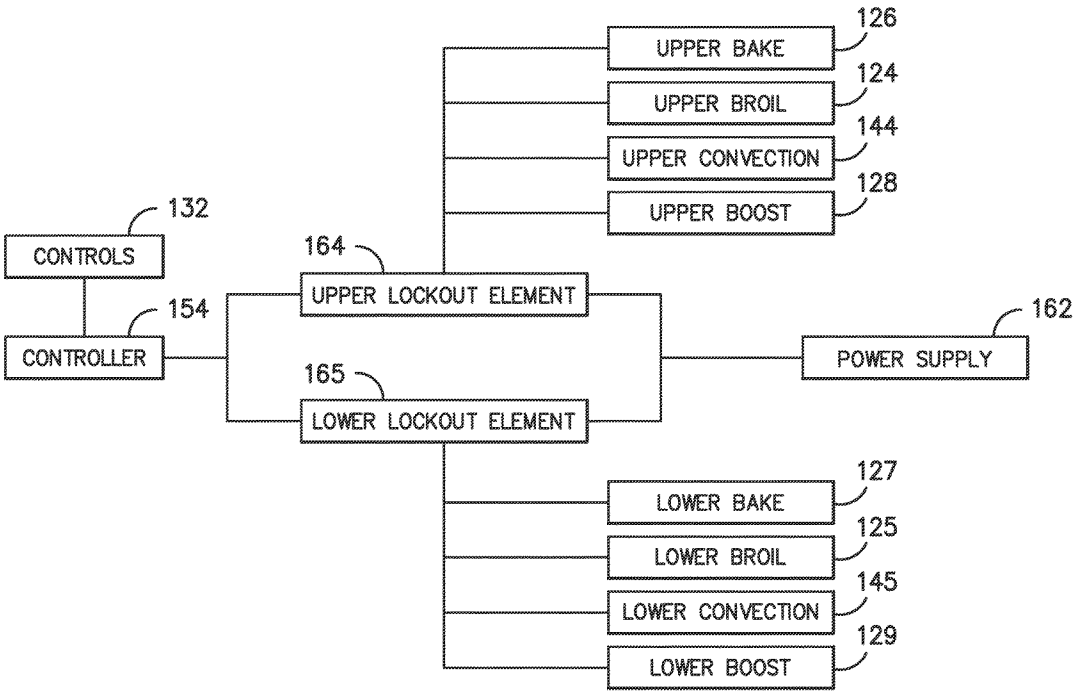
FIG. 4 provides a schematic diagram of an exemplary embodiment of a controller of an exemplary oven appliance of the present subject matter in operative communication with various components of the oven appliance.

Referring now to FIG. 4, in one exemplary embodiment, controller 154 may be in operative communication with various components of oven appliance 100 as shown in the schematic diagram. As previously described, controller 154 is in communication with controls 132, upper heating elements 124, 126, 128, 144, and lower heating elements 125, 127, 129, 145. Thus, by manipulating controls 132, a user can select, e.g., a cooking mode of upper cooking chamber 112 and/or lower cooking chamber 114, a cooking temperature of upper cooking chamber 112 and/or lower cooking chamber 114, or a cleaning cycle of upper cooking chamber 112 and/or lower cooking chamber 114. The selection of a cooking mode, such as, e.g., bake, broil, or convect, and a cooking temperature for one of cooking chambers 112, 114 by the user may initiate a preheat cycle of the cooking chamber. During a preheat cycle, the air and surfaces of the cooking chamber are brought up to temperature for a cooking cycle at the selected temperature in the selected cooking mode.

The preheat cycle may require more time than a user has or is willing to wait for the cooking chamber to come up to temperature. To reduce the time required for the preheat cycle, oven appliance 100 may include a boost preheat mode that may be chosen by the user. When the user chooses the boost preheat mode, one or more heating elements may be used in addition to the heating element typically employed to preheat the cooking chamber, and thereby more heat is input to the cooking chamber during the preheat cycle to decrease the time required to preheat the cooking chamber. However, for oven appliances with, e.g., electric heating elements, the amount of power available to run additional heating elements is limited by the current the appliance can pull from the breaker. Additionally, in oven appliances with more than one cooking chamber, the amount of available power is typically allocated between the cooking chambers. For example, a typical double wall oven is limited to approximately 40 amps on a 240 volt breaker, thus having available about 9600 watts to power the double oven. Usually, the power available to the heating elements of each cooking chamber of the double oven is approximately 4000 watts, with about 1600 watts available to power the controls, fans, lights, and other components.

Thus, to use the power allocated to the unselected cooking chamber to power additional heating elements for a preheat cycle of the selected cooking chamber, the cooking chamber that was not selected for use may be locked out. That is, the heating elements of the unselected cooking chamber may be disconnected from their power supply such that the power otherwise available for the unselected cooking chamber may be used to boost the preheat performance of the selected cooking chamber, as further described below, without, e.g., tripping the breaker. If the user does not choose the boost preheat mode, a normal preheat algorithm may be executed, i.e., a preheat cycle without features for boosting the preheat performance of the selected cooking chamber is executed.

As shown in FIG. 4, to lockout cooking chamber 112, an upper lockout element 164 may be interposed between controller 154, power supply 162, and upper heating elements 124, 126, 128, 144. Similarly, to lockout cooking chamber 114, a lower lockout element 165 may be interposed between controller 154, power supply 162, and lower heating elements 125, 127, 129, 145. Upper and lower lockout elements 164, 165 may be, e.g., a relay or the like that, when closed, allow operative communication between controller 154 and the heating elements and provide power to the heating elements but, when open, disconnect controller 154 and power supply 162 from the heating elements. Different numbers and configurations of upper and lower lockout elements may be used as well. Further, if preheat boost is desired, e.g., only for upper cooking chamber 112, upper lockout element 164 is not required.

Figure 5:
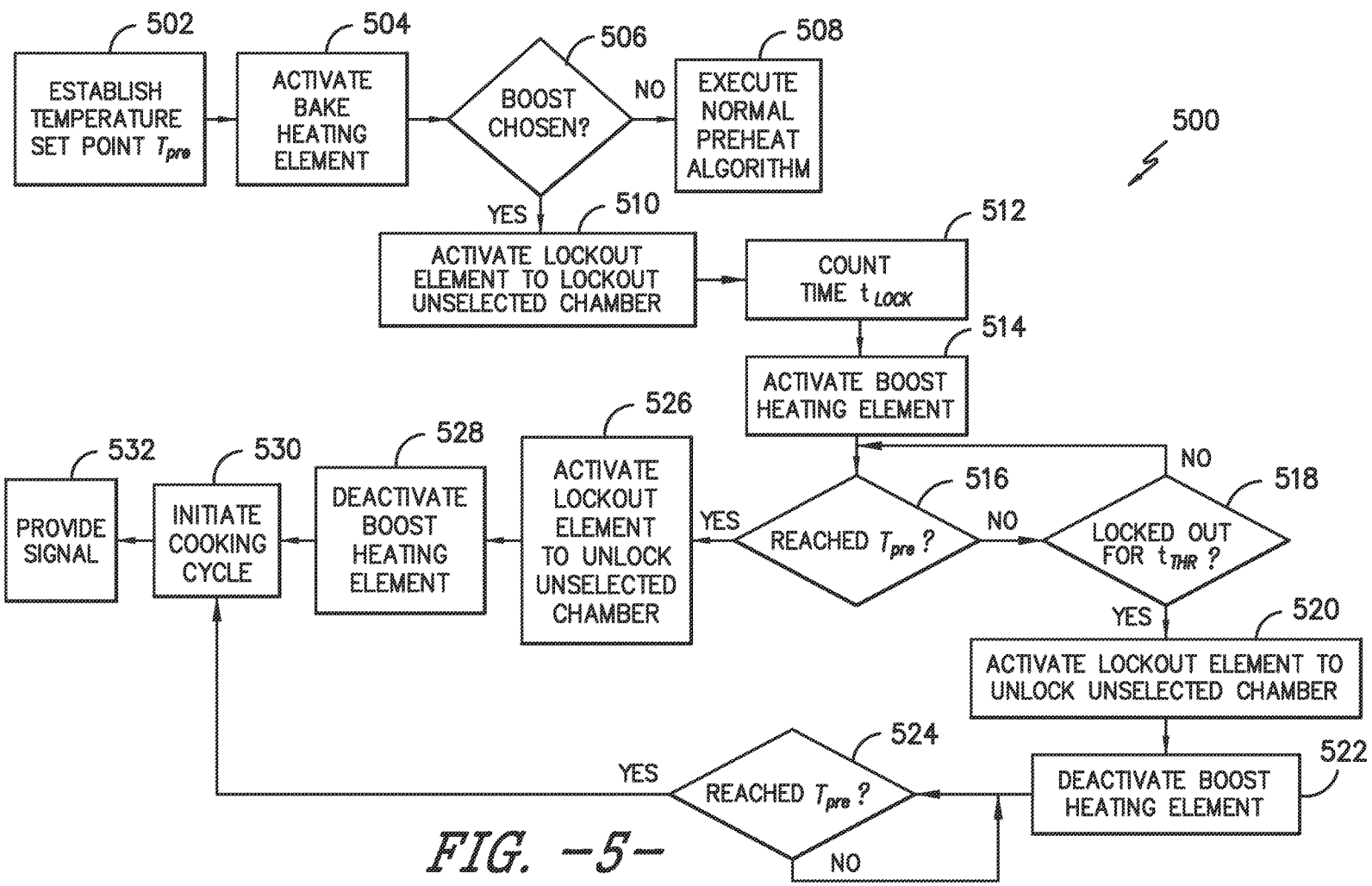
FIG. 5 provides a chart illustrating a method of operating an oven appliance in accordance with one exemplary embodiment of the present subject matter.

FIG. 5 provides a chart illustrating an exemplary method 500 of operating oven appliance 100. Although described below as performed by controller 154, method 500 may be performed in whole or in part by controller 154 or any other suitable device or devices. At step 502, a cooking chamber temperature set point $T_{pre}$ for a preheat cycle is established for a selected cooking chamber, either upper cooking chamber 112 or lower cooking chamber 114. A cooking chamber is selected, e.g., when a user selects a cooking mode, such as, e.g., bake, broil, or convect, and a cooking temperature for one of cooking chambers 112, 114 to initiate a preheat cycle of the cooking chamber. The temperature set point $T_{pre}$ may be determined using the cooking temperature selected by the user of the oven appliance, e.g., the temperature set point $T_{pre}$ may be the cooking temperature selected by the user or a temperature over or under the selected cooking temperature. In alternative embodiments, temperature set point $T_{pre}$ may be a predetermined temperature that is used for each preheat cycle, regardless of the cooking temperature selected by the user. Other values of and methods for determining the temperature set point $T_{pre}$ may be used as well.

After establishing temperature set point $T_{pre}$, at step 504, the bake heating element of the selected cooking chamber is activated, i.e., powered on to heat the selected cooking chamber and, thus, begin a preheat cycle. For example, if the user has selected a cooking mode and a cooking temperature for upper cooking chamber 112, the selected cooking chamber is upper cooking chamber 112 and upper bake heating element 126 is activated at step 504. Alternatively, the user may select to use lower cooking chamber 114 and, thus, lower bake heating element 127 is activated at step 504. In other embodiments, other heating elements, such as the broil or convection heating elements, may be activated to heat the selected cooking chamber, and the convection fan of the selected cooking chamber may also be activated to circulate heated air through the chamber and thereby assist in preheating the air and surfaces of the selected cooking chamber.

At step 506, controller 154 determines whether a boost preheat mode has been chosen. For example, one of the plurality of controls 132 may be, e.g., a button, knob, or the like labeled "Preheat Boost" on control panel 130. When manipulated, the control 132 may signal to controller 154 that the user desires to boost the preheat performance of the selected cooking chamber, i.e., that the user desires to shorten the preheat time for the selected cooking chamber. Other ways of selecting a boost preheat mode and determining whether a boost preheat mode has been selected may be used as well.

If controller 154 determines the boost preheat mode has not been chosen, at step 508, controller 154 executes a normal preheat algorithm, i.e., the preheat cycle proceeds without any input configured to shorten the preheat cycle. However, if the boost preheat mode has been chosen, method 500 proceeds to step 510. At step 510, the lockout element for the unselected cooking chamber is activated to lockout the unselected cooking chamber. That is, the lockout element is activated to disconnect the heating elements of the unselected cooking chamber from power supply 162 by, e.g., opening a relay or the like. As an example, if the selected cooking chamber is upper cooking chamber 112, at step 510 lockout element 165 is activated to lockout lower cooking chamber 114 such that the power that would be available to activate lower heating elements 125, 127, 129, 145 is available to power upper heating elements in addition to upper bake heating element 126 to boost the heat input to upper cooking chamber 112.

At step 512, controller 154 may begin counting a time $t_{lock}$ that the unselected cooking chamber is locked out. Then, at step 514, controller 154 activates the boost heating element of the selected cooking chamber to boost the heat input to the selected cooking chamber as described. Thus, if upper cooking chamber 112 is the selected cooking chamber, at step 514 upper boost heating element 164 is activated to boost the heat input into upper cooking chamber 112 and thereby reduce the time required to preheat cooking chamber 112.

Thereafter, at step 516, controller 154 monitors the temperature of the selected cooking chamber to determine whether the selected cooking chamber has reached at least the set point temperature $T_{pre}$. Controller 154 may monitor the temperature of the selected cooking chamber using, e.g., temperature sensor 150 located in the selected cooking chamber. If the temperature of the selected cooking chamber has not reached at least temperature $T_{pre}$, controller 154 may determine at step 518 whether the time $t_{lock}$ has reached at least a threshold time $t_{thr}$. Time $t_{thr}$ may be, e.g., a time programmed into controller 154 during the manufacture of oven appliance 100 or a time selected by a user of oven appliance 100. If time $t_{lock}$ has not reached at least time $t_{thr}$, as shown in FIG. 5, controller 154 continues to monitor the temperature of the selected cooking chamber and count the time $t_{lock}$ the unselected cooking chamber has been locked out.

However, if at step 518 the time $t_{lock}$ has reached at least time $t_{thr}$, method 500 includes step 520 of activating the lockout element of the unselected cooking chamber to unlock the unselected cooking chamber. Continuing with the above example, if lower cooking chamber 114 was locked out at step 510 by activating lower lockout element 165, when lower cooking chamber 114 has been locked out for at least time $t_{thr}$, lower lockout element 165 is activated to unlock lower cooking chamber 114. That is, if lower lockout element 165 is, e.g., a relay, the relay is closed at step 520 to reconnect lower heating elements 125, 127, 129, 145 to controller 154 and power supply 162. Accordingly, in some embodiments, the unselected cooking chamber may be locked out for only a period of time $t_{thr}$ during a given preheat cycle. In other embodiments, steps 518 through 524 of method 500 may be omitted such that the unselected cooking chamber is locked out until the temperature within the selected cooking chamber reaches at least the temperature set point $T_{pre}$.

Then at step 522, the boost heating element of the selected cooking chamber, e.g., upper boost heating element 144, is deactivated. At step 524, controller 154 determines whether the temperature in the selected cooking chamber has reached at least the set point temperature $T_{pre}$. If not, controller 154 continues to monitor the temperature of the selected cooking chamber using, e.g., temperature sensor 150. If the temperature has reached at least $T_{pre}$, method 500 continues to step 530 described below.

If at step 516 the temperature of the selected cooking chamber has reached at least temperature $T_{pre}$, method 500 includes step 524 of activating the lockout element of the unselected cooking chamber to unlock the unselected cooking chamber. Continuing with the previous example, where the selected cooking chamber is upper cooking chamber 112 and lower cooking chamber 114 was locked out at step 510, when upper cooking chamber 112 reaches at least temperature $T_{pre}$, lower lockout element 165 is activated to unlock lower cooking chamber 114. As described, by unlocking lower cooking chamber 114, lockout element 165 places lower heating elements 125, 127, 129, 145 in operative communication with controller 154 and power supply 162 such that lower heating elements 125, 127, 129, 145 may be activated by controller 154. After the unselected cooking chamber is unlocked, the boost heating element of the selected cooking chamber, e.g., upper boost heating element 144 in the foregoing example, is deactivated at step 528.

When the selected cooking chamber, e.g., upper cooking chamber 112 in the above example, reaches at least temperature $T_{pre}$, the cooking chamber is preheated. As a result, at step 530, the cooking cycle is initiated. At step 532, a signal may be provided to a user of oven appliance 100 that the selected cooking chamber, e.g., upper cooking chamber 112, has reached temperature set point $T_{pre}$ or, alternatively, that the preheat cycle is complete. The signal may be, e.g., any audible and/or visual signal that indicates to the user that the selected cooking chamber has reached at least temperature set point $T_{pre}$. By way of example, the signal may be a notification displayed on control panel 130 of the appliance, an LED light, a buzzer, and/or any other appropriate visual and/or audible signal.

Figure 6:
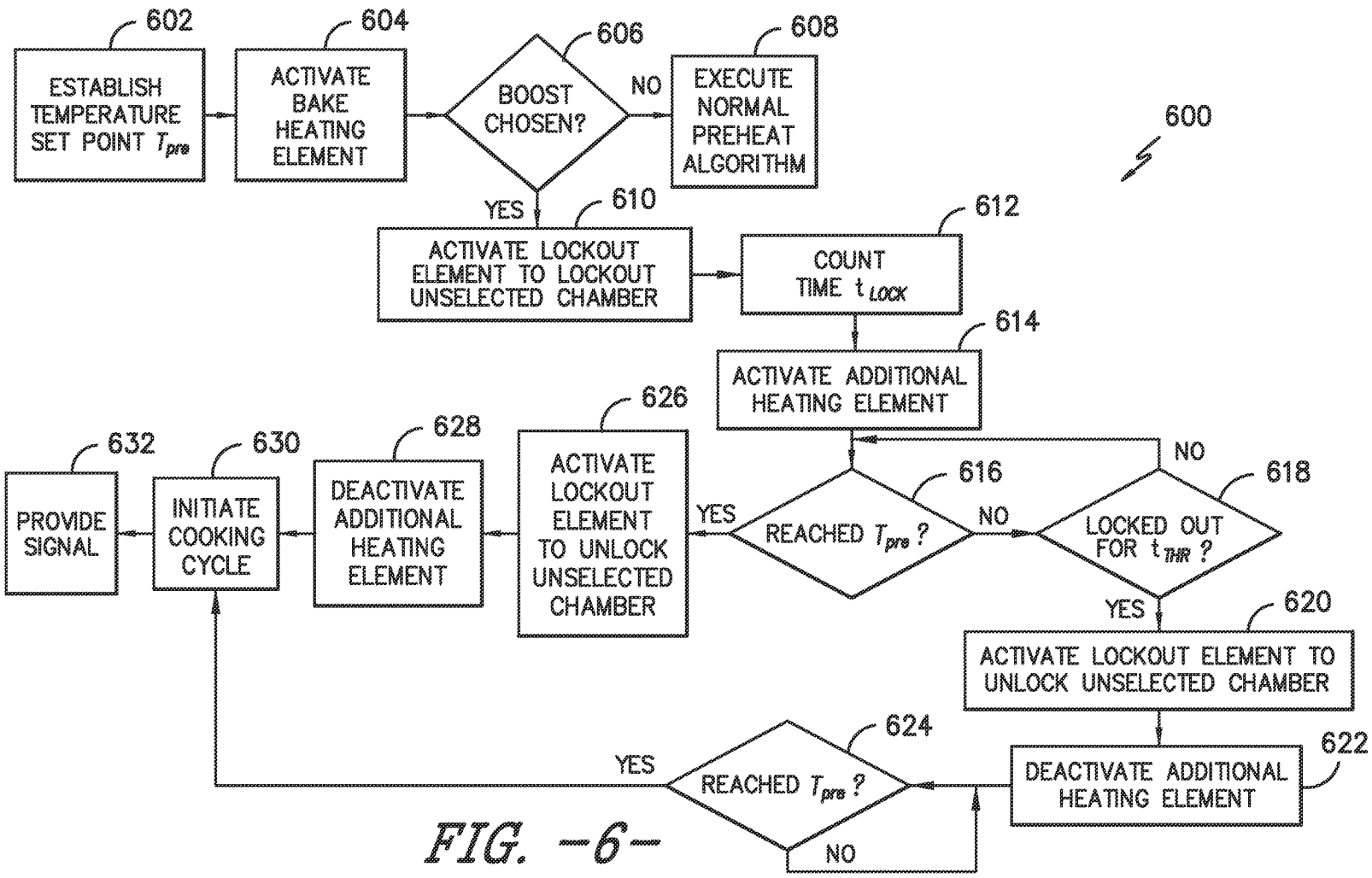
FIG. 6 provides a chart illustrating a method of operating an oven appliance in accordance with another exemplary embodiment of the present subject matter.

FIG. 6 provides a chart illustrating another exemplary method 600 of operating oven appliance 100. Although described below as performed by controller 154, method 600 may be performed in whole or in part by controller 154 or any other suitable device or devices. At step 602, a cooking chamber temperature set point $T_{pre}$ for a preheat cycle is established for a selected cooking chamber, either upper cooking chamber 112 or lower cooking chamber 114. The temperature set point $T_{pre}$ may be determined using the cooking temperature selected by the user of the oven appliance, e.g., the temperature set point $T_{pre}$ may be the cooking temperature selected by the user or a temperature over or under the selected cooking temperature. In alternative embodiments, temperature set point $T_{pre}$ may be a predetermined temperature that is used for each preheat cycle, regardless of the cooking temperature selected by the user. Other values of and methods for determining the temperature set point $T_{pre}$ may be used as well.

After establishing temperature set point $T_{pre}$, at step 604, the bake heating element of the selected cooking chamber is activated, i.e., powered on to heat the selected cooking chamber and, thus, begin a preheat cycle. For example, if the user has selected a cooking mode and a cooking temperature for upper cooking chamber 112, the selected cooking chamber is upper cooking chamber 112 and upper bake heating element 126 is activated at step 604. Alternatively, the user may select to use lower cooking chamber 114 and, thus, lower bake heating element 127 is activated at step 604. In other embodiments, other heating elements, such as the broil or convection heating elements, may be activated to heat the selected cooking chamber, and the convection fan of the selected cooking chamber may also be activated to circulate heated air through the chamber and thereby assist in preheating the air and surfaces of the selected cooking chamber.

At step 606, controller 154 determines whether a boost preheat mode has been chosen. For example, one of the plurality of controls 132 may be, e.g., a button, knob, or the like labeled "Preheat Boost" on control panel 130. When manipulated, the control 132 may signal to controller 154 that the user desires to boost the preheat performance of the selected cooking chamber, i.e., that the user desires to shorten the preheat time for the selected cooking chamber. Other ways of choosing a boost preheat mode and determining whether a boost preheat mode has been chosen may be used as well.

If controller 154 determines the boost preheat mode has not been chosen, at step 608, controller 154 executes a normal preheat algorithm, i.e., the preheat cycle proceeds without any input configured to shorten the preheat cycle. However, if the boost preheat mode has been chosen, method 600 includes step 610 of activating the lockout element of the unselected cooking chamber to lockout the unselected cooking chamber. That is, the lockout element is activated to disconnect the heating elements of the unselected cooking chamber from power supply 162 by, e.g., opening a relay or the like. As an example, if the selected cooking chamber is upper cooking chamber 112, at step 610 lower lockout element 165 is activated to lockout lower cooking chamber 114 such that the power that would be available to activate lower heating elements 125, 127, 129, 145 is available to power upper heating elements in addition to upper bake heating element 126 to boost the heat input to upper cooking chamber 112 to reduce the preheat time of cooking chamber 112.

At step 612, controller 154 may begin counting a time $t_{lock}$ that the unselected cooking chamber is locked out. Then, at step 614, controller 154 activates an additional heating element of the selected cooking chamber to boost the heat input to the selected cooking chamber as described. Thus, if upper cooking chamber 112 is the selected cooking chamber and at step 604 upper bake heating element 126 was activated to heat cooking chamber 112, at step 614 upper broil heating element 124 and/or upper convection heating element 128 is activated to boost the heat input into upper cooking chamber 112 and thereby reduce the time required to preheat cooking chamber 112. In alternative embodiments, the additional heating element may be the boost heating element of the selected cooking chamber, e.g., upper boost heating element 144 in the foregoing example.

Thereafter, at step 616, controller 154 monitors the temperature of the selected cooking chamber to determine whether the selected cooking chamber has reached at least the set point temperature $T_{pre}$. Controller 154 may monitor the temperature of the selected cooking chamber using, e.g., temperature sensor 150 located in the selected cooking chamber. If the temperature of the selected cooking chamber has not reached at least temperature $T_{pre}$, controller 154 may determine at step 618 whether the time $t_{lock}$ has reached at least a threshold time $t_{thr}$. Time $t_{thr}$ may be, e.g., a time programmed into controller 154 during the manufacture of oven appliance 100 or a time selected by a user of oven appliance 100. If time $t_{lock}$ has not reached at least time $t_{thr}$, as shown in FIG. 6, controller 154 continues to monitor the temperature of the selected cooking chamber and count the time $t_{lock}$ the unselected cooking chamber has been locked out.

Otherwise, if at step 618 the time $t_{lock}$ has reached at least time $t_{thr}$, method 600 includes step 620 of activating the lockout element of the unselected cooking chamber to unlock the unselected cooking chamber. Continuing with the above example, if lower cooking chamber 114 was locked out at step 610, when lower cooking chamber 114 has been locked out for at least time $t_{thr}$, lower lockout element 165 is activated to unlock lower cooking chamber 114. That is, if lower lockout element 165 is, e.g., a relay, the relay is closed at step 620 to reconnect lower heating elements 125, 127, 129, 145 to controller 154 and power supply 162. Thus, in some embodiments, the unselected cooking chamber may be locked out for only a period of time $t_{thr}$ during a given preheat cycle. In other embodiments, steps 618 through 624 of method 600 may be omitted such that the unselected cooking chamber is locked out until the temperature within the selected cooking chamber reaches at least the temperature set point $T_{pre}$.

Then at step 622, the boost heating element of the selected cooking chamber, e.g., upper boost heating element 144 in the foregoing example, is deactivated. At step 624, controller 154 determines whether the temperature in the selected cooking chamber has reached at least the set point temperature $T_{pre}$. If not, controller 154 continues to monitor the temperature of the selected cooking chamber using, e.g., temperature sensor 150. If the temperature has reached at least $T_{pre}$, method 600 continues to step 630 described below.

If at step 616 the temperature of the selected cooking chamber has reached at least temperature $T_{pre}$, method 600 includes step 624 of activating the lockout element of the unselected cooking chamber to unlock the unselected cooking chamber. Continuing with the previous example, where the selected cooking chamber is upper cooking chamber 112 and lower cooking chamber 114 was locked out at step 610, when upper cooking chamber 112 reaches at least temperature $T_{pre}$, lower lockout element 165 is activated to unlock lower cooking chamber 114. As described, by unlocking lower cooking chamber 114, lockout element 165 places lower heating elements 125, 127, 129, 145 in operative communication with controller 154 and power supply 162 such that lower heating elements 125, 127, 129, 145 may be activated by controller 154. After the locked out cooking chamber is unlocked, the boost heating element of the selected cooking chamber, e.g., upper boost heating element 144, is deactivated at step 628.

When the selected cooking chamber, e.g., upper cooking chamber 112 in the above example, reaches at least temperature $T_{pre}$, the cooking chamber is preheated. As a result, at step 630, the cooking cycle is initiated. At step 632, a signal may be provided to a user of oven appliance 100 that the selected cooking chamber, e.g., upper cooking chamber 112, has reached temperature set point $T_{pre}$ or, alternatively, that the preheat cycle is complete. The signal may be, e.g., any audible and/or visual signal that indicates to the user that the selected cooking chamber has reached at least temperature set point $T_{pre}$. By way of example, the signal may be a notification displayed on control panel 130 of the appliance, an LED light, a buzzer, and/or any other appropriate visual and/or audible signal.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet, the cabinet defining an upper cooking chamber and a lower cooking chamber, each of the upper and lower cooking chamber configured for receipt of food items for cooking:

a plurality of upper heating elements, the upper heating elements configured to heat the upper cooking chamber;

a plurality of lower heating elements, the lower heating elements configured to heat the lower cooking chamber;

a lockout element: and a controller in operative communication with the upper and lower heating elements and the lockout element, the controller configured for establishing a cooking chamber temperature set point $T_{pre}$ for a selected cooking chamber, wherein the selected cooking chamber comprises one of the upper or the lower cooking chamber;

activating one of the plurality of heating elements of the selected cooking chamber; determining whether a boost preheat mode of the selected cooking chamber has been chosen and, if so, then activating the lockout element to lockout the unselected cooking chamber;

activating an additional heating element of the selected cooking chamber;

sensing whether the temperature in the selected cooking chamber has reached at least $T_{pre}$ and, if so, then activating the lockout element to unlock to the unselected cooking chamber, and initiating a cooking cycle of the selected cooking chamber.

2. The oven appliance of claim 1, wherein the controller is further configured for providing a signal to a user of the oven appliance, during the step of initiating the cooking cycle, that the temperature of the selected cooking chamber has reached at least $T_{pre}$.

3. The oven appliance of claim 1, wherein the controller is further configured for counting a time $t_{lock}$ during the step of activating the lockout element to lockout the unselected cooking chamber.

4. The oven appliance of claim 3, wherein if the temperature in the selected cooking chamber has not reached at least Tpre, the controller is further configured for determining whether time $t_{lock}$ has reached at least a threshold time $t_{thr}$ and, if so, then activating the lockout element to unlock the unselected cooking chamber.

5. The oven appliance of claim 1, wherein the controller is further configured for executing a normal preheat algorithm if the boost preheat mode of the selected cooking chamber has not been chosen.

6. The oven appliance of claim 1, wherein the additional heating element comprises a boost heating element of the selected cooking chamber.

7. The oven appliance of claim 1, wherein the controller is configured to activate a bake heating element of the selected cooking chamber at the step of activating one of the plurality of heating elements of the selected cooking chamber, and wherein the controller is configured to activate one of a broil heating element and a convection heating element at the step of activating an additional heating element of the selected cooking chamber.

8. A method for operating the oven appliance of claim 1, the oven appliance having an upper cooking chamber and a lower cooking chamber each configured for receipt of food items for cooking, the method comprising the steps of:

establishing a cooking chamber temperature set point Tpre for a selected cooking chamber, wherein the selected cooking chamber comprises one of the upper or the lower cooking chamber;

activating a heating element of the selected cooking chamber;

determining whether a boost preheat mode of the selected cooking chamber has been chosen and, if so, then activating a lockout element to lockout the unselected cooking chamber;

activating an additional heating element of the selected cooking chamber;

sensing whether the temperature in the selected cooking chamber has reached at least Tpre and, if so, then activating the lockout element to unlock to the unselected cooking chamber, and initiating a cooking cycle of the selected cooking chamber.

9. The method of claim 8, further comprising the step of providing a signal to a user of the oven appliance, during the step of initiating the cooking cycle, that the cooking chamber temperature has reached at least $T_{pre}$.

10. The method of claim 8, further comprising the step of counting a time $t_{lock}$ during the step of activating the lockout element to lockout the unselected cooking chamber.

11. The method of claim 10, wherein if the temperature in the selected cooking chamber has not reached at least Tpre, the method further comprises the steps of:

determining whether the time has reached at least a threshold time $t_{thr}$ and, if so, then activating the lockout element to unlock the unselected cooking chamber;

sensing whether the temperature in the selected cooking chamber has reached at least $T_{pre}$ and, if so, then initiating the cooking cycle of the selected cooking chamber.

12. The method of claim 8, further comprising the step of executing a normal preheat algorithm if the boost preheat mode of the selected cooking chamber has not been chosen.

13. The method of claim 8, wherein the step of activating the lockout element to lockout the unselected cooking chamber comprises opening a relay between the heating elements of the unselected cooking chamber and a power supply.

14. A method for operating the oven appliance of claim 1, the oven appliance having an upper cooking chamber and a lower cooking chamber each configured for receipt of food items for cooking, the method comprising the steps of:

establishing a cooking chamber temperature set point $T_{pre}$ for a selected cooking chamber, wherein the selected cooking chamber comprises one of the upper or the lower cooking chamber; activating a heating element of the selected cooking chamber;

determining whether a boost preheat mode of the selected cooking chamber has been chosen and, if so, then activating a lockout element to lockout the unselected cooking chamber; counting a time $t_{lock}$ activating an additional heating element of the selected cooking chamber; determining whether the time $t_{lock}$ has reached at least a threshold time for and, if so, then activating the lockout element to unlock to the unselected cooking chamber.

15. The method of claim 14, further comprising the steps of: sensing, after the step of activating the lockout element to unlock the unselected cooking chamber, whether the temperature in the selected cooking chamber has reached at least $T_{pre}$ and, if so, then initiating a cooking cycle of the selected cooking chamber, and providing a signal to a user of the oven appliance that the selected cooking chamber temperature has reached at least $T_{pre}$.

16. The method of claim 14, wherein the step of activating a heating element of the selected cooking chamber comprises activating a bake heating element of the selected cooking chamber, and wherein the step of activating an additional heating element of the selected cooking chamber comprises activating a broil heating element of the selected cooking chamber.

17. The method of claim 14, wherein the step of activating a heating element of the selected cooking chamber comprises activating a bake heating element of the selected cooking chamber, and wherein the step of activating an additional heating element of the selected cooking chamber comprises activating a convection heating element of the selected cooking chamber.

18. The method of claim 14, wherein the step of activating a heating element of the selected cooking chamber comprises activating a bake heating element of the selected cooking chamber, and wherein the step of activating an additional heating element of the selected cooking chamber comprises activating a broil heating element and a convection heating element of the selected cooking chamber.

19. The method of claim 14, further comprising the steps of:

sensing, during the step of determining whether the time has reached at least the threshold time $t_{thr}$, whether the temperature in the selected cooking chamber has reached at least $T_{pre}$ and, if so, then activating the lockout element to unlock the unselected cooking chamber, and initiating a cooking cycle of the selected cooking chamber.

* * * * *